United States Patent [19]

Czelusniak, Jr.

[11] 4,403,633

[45] Sep. 13, 1983

[54] WOVEN PILE FABRIC

[75] Inventor: Paul A. Czelusniak, Jr., Eden, N.C.

[73] Assignee: Fieldcrest Mills, Inc., Eden, N.C.

[21] Appl. No.: 272,505

[22] Filed: Jun. 11, 1981

[51] Int. Cl.[3] ..... D03D 27/06

[52] U.S. Cl. ..... 139/402

[58] Field of Search ..... 139/402, 403, 391, 399, 139/46, 419

[56] References Cited

U.S. PATENT DOCUMENTS

| | | | |
|---|---|---|---|
| 2,655,951 | 10/1953 | Clark | 139/403 |
| 3,091,263 | 5/1963 | Troy | 139/402 |
| 3,625,260 | 12/1971 | Troy | 139/402 |

*Primary Examiner*—James Kee Chi

*Attorney, Agent, or Firm*—Bell, Seltzer, Park and Gibson

[57] ABSTRACT

Tufted pile fabrics formed from two sets of pile yarns and groups of ground warp yarns wherein the number of pile yarns forming the face of the fabric remains constant throughout the fabric so as to normally provide a uniform pile density. Each of the sets of pile yarns is at times forming pile tufts and at other times is hidden from view by being floated and woven with the base. Further, one warp-wise extending row of pile tufts formed from pile yarns of both sets is provided for each group of ground warp yarns.

9 Claims, 4 Drawing Figures

WOVEN PILE FABRIC

This invention relates to woven fabrics and more particularly to woven pile fabrics of the type typically formed by transversely shogging pile yarns over and across warpwise extending pile wires.

The fabrics of this invention may be made with a variety of pattern effects and are distinct from prior art fabrics in that the number of pile yarns throughout the face of the fabric remains constant and does not vary as in prior art fabrics of this type. In this regard, it will be appreciated by those versed in the weaving of pile fabrics that, when it was desired, for example to bring a particular color to the face of the fabric, the particular pile yarn would have to be buried or hidden from view except in those areas where the color was to be visible. This occasioned a variance in the number of pile yarns and an attendant variance in pile density throughout the face of the fabric.

Fabrics of the instant invention are formed of two sets of pile yarns, with only one of the sets of pile yarns at any given time forming pile tufts and with the inactive set of pile yarns being hidden from view and woven with the underlying base fabric. Further, fabrics made in accordance with the instant invention also have groups of ground warp yarns extending throughout the fabric. In this instance, there are twice as many pile yarns provided so that, instead of having one pile yarn cooperating with each group of ground warp yarns, two pile yarns are provided which are selectively brought to the face of the fabric, with the inactive yarn thus being floated and hidden from view.

BRIEF DESCRIPTION OF THE DRAWINGS

Some of the features and advantages of the invention having been stated, others will appear as the description proceeds when taken in connection with the accompanying drawings in which.

DETAILED DESCRIPTION

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Figure 1:
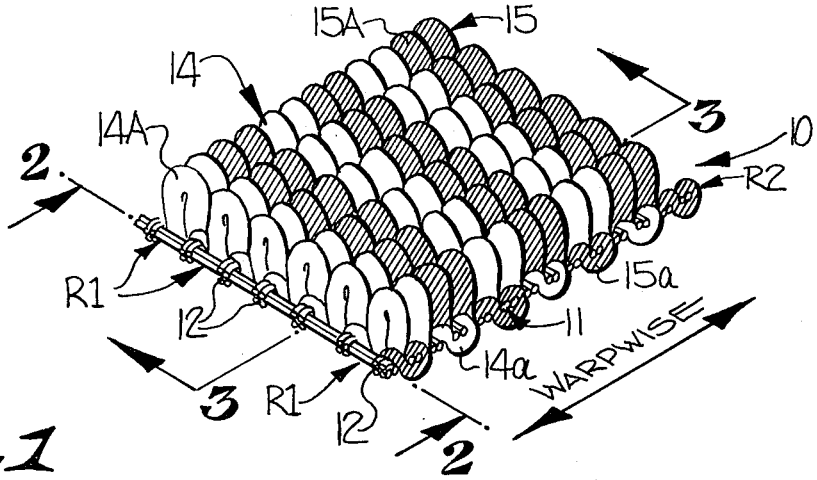
FIG. 1 is a perspective view showing a woven loop pile fabric constructed in accordance with the present invention.
Figure 2:
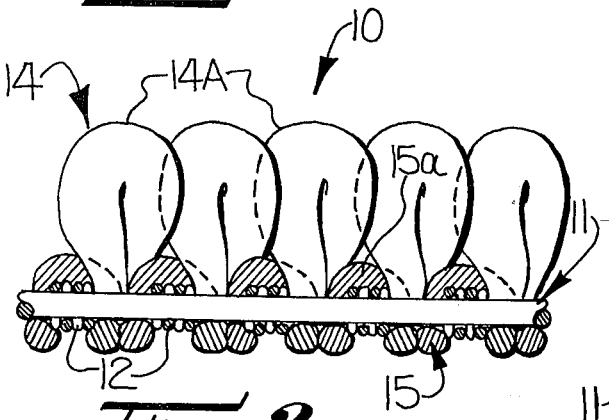
FIG. 2 is an enlarged fragmentary weftwise or transverse vertical sectional view taken substantially along line 2—2 in FIG. 1.
Figure 3:
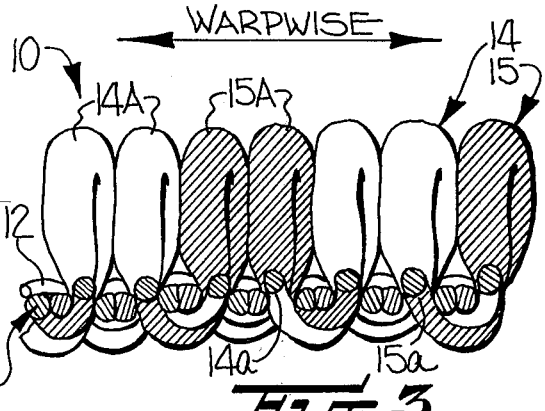
FIG. 3 is an enlarged fragmentary warpwise or longitudinal vertical sectional view taken substantially along line 3—3 in FIG. 1.

Referring now to FIGS. 1–3, wherein an embodiment of the woven pile fabric of this invention is broadly designated at 10, it will be observed that the fabric is woven of ground weft yarns 11, groups of ground or chain warp yarns 12, and at least two sets of pile yarns 14, 15 forming warpwise extending rows R1 of pile tufts. It is preferred that the pile yarns of each set are of different visual characteristics from the pile yarns of the other set, such as color, shade, texture, twist, type, size, or the like, in order that the desired pattern effects may be obtained. As shown, the pile tufts in each warpwise row are in the form of loop pile. It is apparent, however, that some or all of the pile tufts may be in the form of cut pile, as desired.

As preferred, the pile fabric 10 is constructed in the form of a so-called "single-shot" or "one-shot" weave characterized in that a row of pile tufts is anchored in the base fabric between each adjacent pair of weft yarns or "weft shots" 11. In this instance, each weft yarn or shot is formed of two weftwise textile strands, but may be in the form of a single textile strand, if desired. Also, although four warp yarns are illustrated in each group of ground warp yarns 12 interwoven with the weft yarns 11 and extending throughout the fabric 10, it is apparent that a lesser or greater number of warp yarns 12 may be provided in each group, if desired, without departing from the invention.

Figure 4:
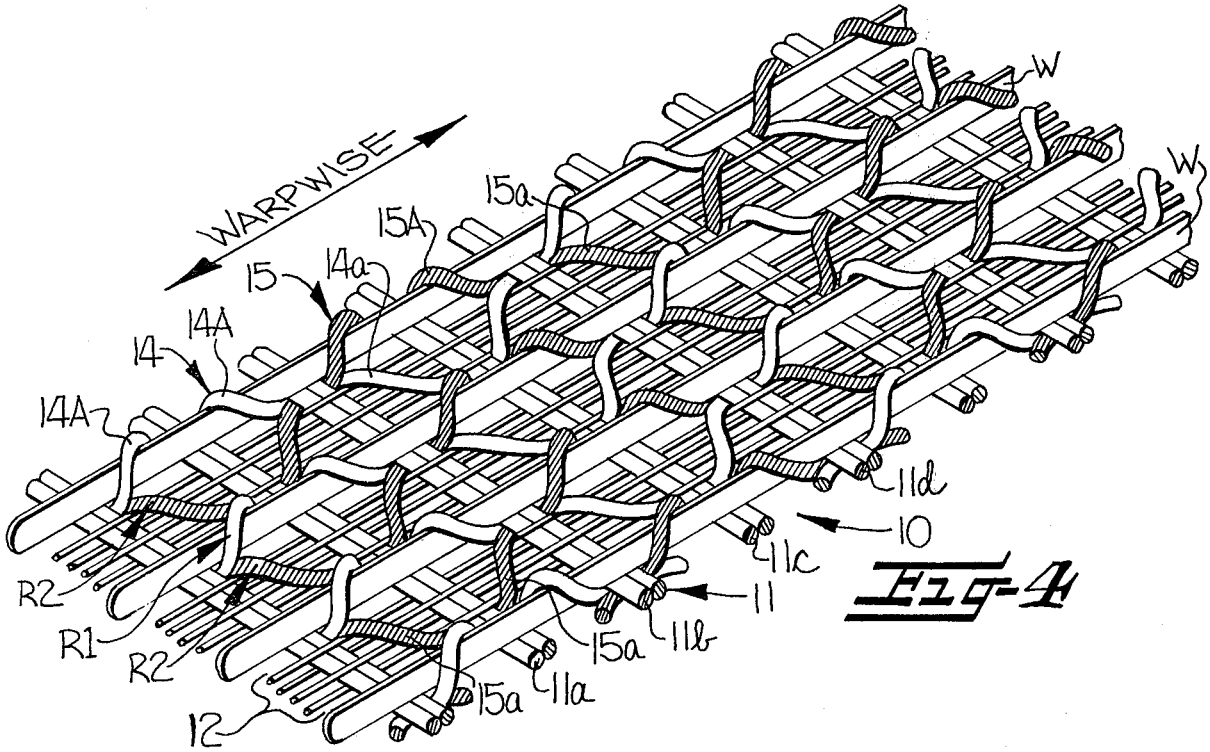
FIG. 4 is a schematic perspective view showing an arrangement of warpwise pile wires in exaggerated spaced relationship overlying a portion of the pile fabric of the present invention and illustrating how the pile tufts and pile yarn floats thereof may be formed during weaving.

According to the invention, each warpwise extending row R1 of pile tufts is formed of pile yarns from both sets of pile yarns 14, 15 arranged in a predetermined alternate sequence warpwise of the fabric. It is important to note that the pile yarns of only one of the sets of pile yarns is in the form of pile tufts in any given weftwise row of pile tufts and that the pile yarns of the respective other set of pile yarns are inactive and hidden from view by the pile tufts of those pile yarns of the said one set of pile yarns, as will be later explained more in detail. Accordingly, two pile yarns (one pile yarn from each set of pile yarns) cooperate with each group of ground warp yarns 12 and are selectively brought to the face of the fabric as tufts, with the inactive pile yarn being floated and undulatingly arranged over and across the respective group of warp yarns 12 and under the weft yarns 11, as best illustrated in FIGS. 2 and 4. It follows that the number of pile yarns forming the pile tufts is constant throughout the fabric and thereby facilitates obtaining uniform pile density in the fabric.

Reference characters 14A, 15A indicate those tufts formed of the respective pile yarns 14, 15 in any given warpwise row R1 of pile tufts. Also, as best shown in FIG. 4, warpwise rows R2 of floats **14*a*, 15*a* formed from the respective sets of pile yarns 14, 15 extend between the warpwise extending rows R1 of pile tufts 14A, 15A and across and over groups of warp yarns 12 positioned between the rows R1 of pile tufts. The rows R2 of pile yarn floats 14*a*, 15*a* are thus formed from both sets of pile yarns 14, 15. The portions of the sets of pile yarns 14, 15 which form the rows R2 of pile yarn floats 14*a*, 15*a* are arranged in a predetermined alternate sequence warpwise of the fabric, but in out-of-phase relation to the alternating sequence of arrangement of the respective portions of the sets of the pile yarns 14, 15 which form the rows R1 of the pile tufts 14*a*, 15*a***. Thus, it can be seen that pile yarns from both sets may selectively and alternately form the pile tufts of the woven pile fabric to provide enhanced pattern effects.

For purposes of clarity, the floats **14*a*, 15*a* formed of the respective pile yarns 14, 15 are shown exposed in FIG. 4 to better illustrate the floats 14*a*, 15*a* extending over and across the groups of warp yarns 12. However, as shown in FIGS. 1–3, the pile yarn floats 14***a*, 15*a* are hidden from view by the adjacent rows R1 of pile tufts 14A, 15A so that the pile yarn floats 14*a*, 15*a* need not adversely affect the appearance of the pile face of the fabric 10, but serve to interconnect those successive tufts of any given pile yarn which are spaced warpwise of each other and which have tufts of another of the pile yarns positioned therebetween. This arrangement readily permits forming the desired pitch of pile fabric; i.e., this arrangement permits forming the desired number of warpwise extending rows of pile tufts per widthwise inch of the fabric, due to the fact that a warpwise row of pile tufts extends throughout the length of each respective group of ground warp yarns 12 in the fabric. Furthermore, by extending the pile yarn floats 14*a*, 15*a* over and across the groups of warp yarns 12 and under the adjacent weft yarns 11, this insures that the pile yarn portions extending warpwise between successive groups of tufts formed of a given pile yarn are properly supported along their lengths between the points at which they are anchored to the base fabric.

To aid in the description of the construction of the fabric more in detail, there will be observed in FIG. 4 a portion of the fabric as it is being woven on a loom of a type having warpwise pile formers or pile wires W which extend over the base fabric formed of the ground weft yarns 11 and ground warp yarns 12, and wherein the two sets of pile yarns 14, 15 are alternatively shogged weftwise over and across each pile wire for forming pile loops in a manner generally known in the weaving art. A typical loom of this type is disclosed in U.S. Pat. No. 3,636,988, issued to Troy et al on Jan. 25, 1972, to which reference is made for a more detailed description of such a loom, as may be desired for more clearly understanding the construction of the fabric of the present invention.

It can be seen in FIG. 4 that the pile wires W are positioned to extend warpwise over spaces between adjacent groups of ground warp yarns 12, and as the pile yarns 14 of one set are being shogged in one direction weftwise over the respective pile wires W in the lower portion of FIG. 4, the pile yarns 15 of the other set are being shogged in the opposite direction weftwise over and across the respective groups of ground warp yarns 12. Thereafter, a shot of weft yarn, such as is indicated at 11*a* in FIG. 4, is inserted through the warp shed formed of the ground warp yarns 12 and over the pile yarns 14, 15 and then beaten up to anchor the corresponding tufts 14A and floats 15*a* in the base fabric.

Following the beat-up of the conventional beating means of the loom, the two sets of pile yarns are again shogged weftwise, but in the opposite direction from that in which they had last previously been shogged, to again form pile tufts 14A of the set of pile yarns 14 and pile yarn floats 15*a* of the respective pile yarns 15 with the loops of the pile tufts being diagonally arranged in the corresponding warpwise rows being formed and with the pile yarn floats also extending diagonally in the respective warpwise rows of the pile yarn floats being formed. Thereafter, and following the inserting and beating up of the shot of weft yarn indicated at 11*b* in FIG. 4, the two sets of pile yarns are shogged again, but this time, it will be observed that the pile yarns 14 cross the pile yarns 15, and instead of the pile yarns 14 then being shogged over and across the pile wires W, the pile yarns 15 are shogged over and across the pile wires W as the pile yarns 14 are shogged over and across the respective groups of ground warp yarns 12 to form tufts 15*a* and floats 14*a*, respectively.

A shot of weft yarn such as is indicated at 11*c* in FIG. 4 is then inserted and beaten up in the same manner as the shots of weft yarn 11*a*, 11*b*, whereupon the pile yarns 14 and 15 are respectively shogged weftwise in the opposite directions from that in which they are last previously shogged so that the pile yarns 14 of one set are again shogged over and across the respective groups of warp yarns 12 as the pile yarns 15 of the other set are shogged over and across the respective pile wires W. Thereupon, an additional shot of weft yarn 11*d* is inserted in the warp shed and beaten up to complete a cycle in the forming of the particular fabric illustrated in FIG. 4.

It is thus seen that warpwise rows R1 of pile tufts 14A, 15A are formed from both sets of pile yarns 14, 15 arranged in a predetermined alternate sequence warpwise of the fabric, with warpwise extending rows R2 of pile yarn floats 14*a*, 15*a* hidden from view extending between the warpwise extending rows of pile tufts and across and over the groups of warp yarns 12 positioned between the rows of pile tufts. In the fabric pattern illustrated, each warpwise row R1 of tufts includes warpwise spaced pairs or groups of tufts 14A formed from a pile yarn 14 of one of the sets of pile yarns with intervening pairs or groups of tufts 15A of a pile yarn 15 of the other set positioned between adjacent pairs of the warpwise spaced groups of tufts 14A. Although only two successive tufts of any given pile yarn are illustrated in each group in each warpwise row of tufts R1, it is apparent that each group of pile tufts may include a greater number of tufts therein according to the desired pattern. In any event, it is to be noted that the rows of pile yarn floats are formed of pile yarns from both sets of pile yarns arranged in a predetermined alternate sequence warpwise of the fabric, but in out-of-phase relation to the alternating sequence of arrangement of the sets of pile yarns forming the rows of pile tufts.

It will be observed in FIG. 4 that the tufts 14*a*, 15*a* when in the form of loop pile, are diagonally arranged in the respective rows R1, and the pile yarn floats 14*a*, 15*a* also extend diagonally in the rows R2 of pile yarn floats. Further, the alternate pile loops in each warpwise row of pile tufts R1 extend diagonally in the opposite direction from intervening pile loops in each such row with the alternate pile yarn floats in each warpwise row of pile yarn floats also extending in an opposite diagonal direction from intervening pile yarn floats in each warpwise row. It will also be observed in FIG. 4 that the pile loops and pile yarn floats are arranged in transverse rows throughout the width of the fabric with the pile loops in each transverse row extending in an opposite diagonal direction from that of weftwise adjacent pile yarn floats in each transverse row.

In the drawings and specification, there has been set forth a preferred embodiment of the invention, and although specific terms are employed, they are used in a generic and descriptive sense only, and not for purposes of limitation, the scope of the invention being defined in the claims.

That which is claimed is:

1. A woven pile fabric formed from weft yarns, groups of warp yarns, and two sets of pile yarns forming warpwise extending rows of pile tufts, each warpwise extending row of pile tufts being formed of pile yarns from both sets of pile yarns with the tufts formed of the two sets being arranged in a predetermined alternating sequence in each row warpwise of the fabric, and warpwise extending rows of pile yarn floats hidden from view extending between said warpwise extending rows of pile tufts and across and over groups of warp yarns positioned therebetween, said rows of pile yarn floats being formed of pile yarns from both sets of pile yarns with the floats formed of the two sets being arranged in a predetermined alternating sequence warpwise of the fabric but in out-of-phase relation to said alternating sequence of arrangement of the tufts formed of the two sets of pile yarns forming the rows of pile tufts whereby pile yarns from both sets selectively and alternately form the pile tufts of the fabric to provide enhanced pattern effects.

2. A woven pile fabric according to claim 1 wherein the number of pile tufts is constant throughout the fabric to thereby facilitate obtaining uniform pile density in the fabric.

3. A woven pile fabric according to claim 1 wherein said warpwise extending rows of pile tufts are loop pile with the loops of the pile tufts being diagonally arranged in said rows, and wherein said pile yarn floats also extend diagonally in said rows of pile yarn floats.

4. A woven pile fabric according to claim 3 wherein alternate pile loops in each warpwise row of pile tufts extend diagonally in an opposite direction from intervening pile loops in each row.

5. A woven pile fabric according to claim 3 or 4 wherein alternate pile yarn floats in each warpwise row of pile yarn floats extend in an opposite diagonal direction from intervening pile yarn floats in each warpwise row and wherein the pile loops and pile yarn floats are arranged in transverse rows throughout the width of the fabric with the pile loops in each transverse row extending in an opposite diagonal direction from that of adjacent pile yarn floats in each transverse row.

6. A woven pile fabric according to claim 1 wherein said weft yarns extend across and over the end portions of said floats whereby the floats are undulatingly arranged over and across said groups of warp yarns and under said weft yarns.

7. A woven pile fabric formed from weft yarns, groups of warp yarns, and two sets of pile yarns forming warpwise extending rows of pile tufts, each warpwise extending row of pile tufts being positioned between adjacent groups of said warp yarns and formed of pile yarns from both sets of pile yarns with the tufts formed of the two sets being arranged in a predetermined alternating sequence in each row warpwise of the fabric, and warpwise extending rows of pile yarn floats hidden from view extending between said warpwise extending rows of pile tufts and across and over groups of warp yarns positioned therebetween, said rows of pile yarn floats being formed of pile yarns from both sets of pile yarns with the floats formed of the two sets being arranged in a predetermined alternating sequence warpwise of the fabric but in out-of-phase relation to said alternating sequence of arrangement of the tufts formed of the two sets of pile yarns forming the rows of pile tufts whereby pile yarns from both sets selectively and alternately form the pile tufts of the fabric to provide enhanced pattern effects.

8. A woven pile fabric according to claim 7 wherein there is a warpwise row of pile tufts alongside each group of warp yarns.

9. A woven pile fabric according to claim 7 wherein the number of pile tufts is constant throughout the fabric to thereby facilitate obtaining uniform pile density in the fabric.

* * * * *